United States Patent [19]

Margard

[11] 4,331,095

[45] May 25, 1982

[54] ARRANGEMENT FOR DIVIDING A SHIP'S FREE LIQUID SURFACE

[75] Inventor: Gunnar Mårgård, Karlstad, Sweden

[73] Assignee: Karlstads Handels - och Konsult AB, Karlstad, Sweden

[21] Appl. No.: 29,437

[22] Filed: Apr. 12, 1979

[30] Foreign Application Priority Data

Apr. 28, 1978 [SE] Sweden ..... 7804941

[51] Int. Cl.[3] ..... B63H 9/04

[52] U.S. Cl. ..... 114/201 R; 114/74 R

[58] Field of Search ..... 114/72, 73, 74 R, 75, 114/201 R, 122, 125, 126

[56] References Cited

U.S. PATENT DOCUMENTS

| | | | |
|---|---|---|---|
| 1,835,855 | 12/1931 | Fliegel | 114/201 |
| 2,773,469 | 12/1956 | Caruthers et al. | 114/201 R |
| 3,286,677 | 11/1966 | Hilliard | 114/74 R |
| 3,504,650 | 4/1970 | De Leon | 114/75 |

FOREIGN PATENT DOCUMENTS

| | | | |
|---|---|---|---|
| 37220 | 3/1965 | German Democratic Rep. | 114/125 |

*Primary Examiner*—Edward R. Kazenske
*Assistant Examiner*—Jésus D. Sotelo
*Attorney, Agent, or Firm*—Silverman, Cass & Singer, Ltd.

[57] ABSTRACT

An arrangement for dividing the free liquid surface of a liquid cargo contained in a general cargo or bulk cargo ship. The arrangement includes parallel upright metal sheets forming a plurality of parallel shieldings and a plurality of compartments located side by side. The sheets are adapted to be attached in the horizontal hatch of a ship with the metal sheets vertically upright in the hatch. While arranged in the hatch, the lower edges of the sheets are located below the free liquid surface of the liquid cargo and the upper edges of the metal sheets are located at or above the free liquid surface of the liquid cargo.

5 Claims, 5 Drawing Figures

21'
35
34

33
32
27
18
20
22
5
31
22
28
19
21
58
15
24
30
29
23
11
25

ARRANGEMENT FOR DIVIDING A SHIP'S FREE LIQUID SURFACE

BACKGROUND OF THE INVENTION

This invention relates to an arrangement for dividing the free liquid surface of ships, especially of general cargo and bulk cargo ships.

General cargo and bulk cargo ships, especially of small tonnage, usually are equipped so as to be capable to carry substantially only piece goods and bulk goods. Such ships cannot carry liquid cargo, for example oil. The reason of this is that the horizontal cross-sectional area of the holds relative to the ship is so great, that a free liquid surface corresponding to said cross-sectional area would render the ship instable.

Ships of greater tonnage, especially those of the so-called OB(Oil and Bulk)-type, are so constructed that the holds are provided with bulkheads, which are elongated into the holds, and with frames, so that the free liquid surface is much smaller than the horizontal cross-sectional area of the hold.

If the holds of ships of small tonnage were divided in a corresponding way, this would render the loading and unloading operations much more difficult or impossible and, besides, the hold volume would be reduced substantially.

The present invention solves the aforesaid problems, in that the arrangement according to the invention renders it possible to ship liquids, such as oil, on general cargo and bulk cargo ships, the holds of which are intended to carry goods other than liquids.

The present invention thus relates to an arrangement for dividing the free liquid surface of a liquid cargo at the shipment of the liquid, especially on general cargo and bulk cargo ships.

SUMMARY OF THE INVENTION

The invention is characterized in that the arrangement is intended to be removably positioned in a hold-hatch, and that it consists of one or several units, which comprise interconnected, preferably parallel upright metal sheets forming a plurality of parallel shieldings or a plurality of compartments located side by side, that each unit is dimensioned so as to fit into a portion of a hatch or into the entire hatch, and each unit is adapted to be positioned in the hatch with the metal sheets being substantially in vertical upright position, so that the lower edge of the sheets is located beneath the upper surface of the liquid cargo, and the upper edge of the sheets is at or above the upper surface.

BRIEF DESCRIPTION OF THE DRAWINGS

The invention is described in greater detail in the following, with reference to the accompanying drawings, in which.

DESCRIPTION OF THE PREFERRED EMBODIMENT

Figure 1:
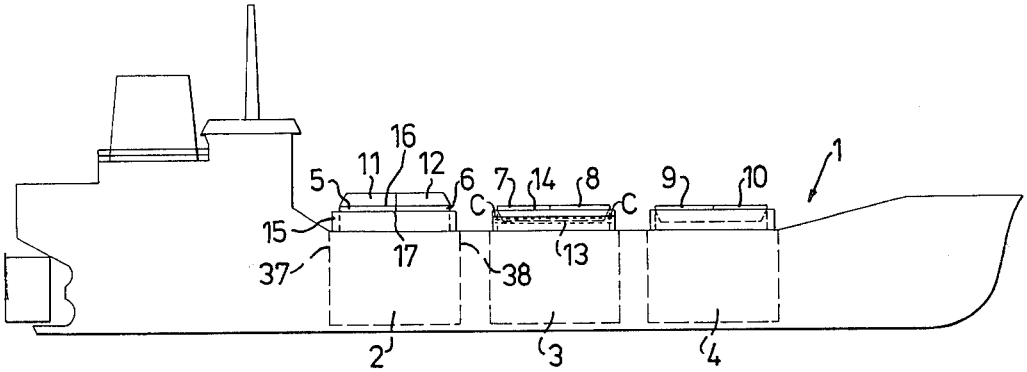
FIG. 1 is a lateral view of a ship.
Figure 2:
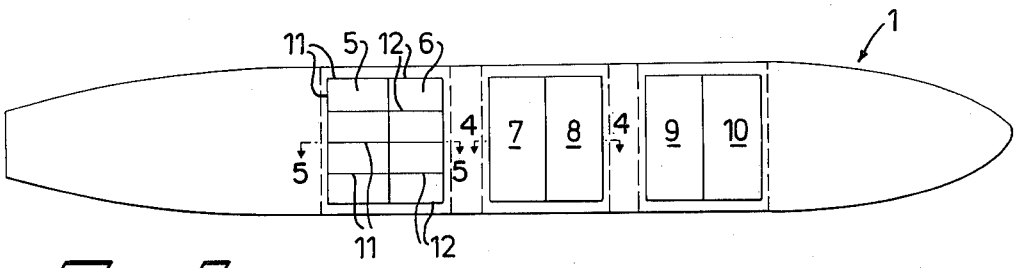
FIG. 2 is a view from above of a ship.

In FIGS. 1 and 2 a general cargo or bulk cargo ship 1 is shown, which has six holds 2,3,4 and three hatch-covers 5,6,7,8,9,10 attached to the hatches above the holds. Each hatch, thus, is covered by two hatch-covers. At the hatch-covers 5–10 shown in FIGS. 1 and 2, arrangements according to the invention are provided.

The arrangements according to one embodiment comprise a number of interconnected parallel upright metal sheets 11,12, which form a rigid unit. The sheets 11,12 have a thickness, for example 1 to 2 cm, which is necessary to withstand the forces caused by splashings of the liquid cargo. The sheets 11,12 are arranged so as to form a plurality of parallel shieldings or a plurality of compartments located side by side, as appears from the two left-hand hatch-covers 5,6 in FIG. 2.

At a view such as in FIG. 2, thus, the sheets 11,12 form a checkered compartment network. The sheets, of course, can be arranged to form a rhombic compartment or other suitable compartment shapes.

According to a preferred embodiment, the sheets 11,12 form a number of rectangular compartments, the inside width by length of which preferably is substantially equal to 8 by 20 feet or 8 by 40 feet, or corresponding other measures of so-called international standard containers.

The arrangement according to the invention shown in FIGS. 1 and 2 is designed as a unit, which comprises a number of sheets 11,12 and is intended to cover a portion of a hatch. The units, of course, also can be designed so as to cover the entire hatch.

The sheets 11,12 when in use are intended to be positioned substantially vertically upright, so that their lower edge 13 is located below the upper surface, indicated in FIG. 1 by the level C, of a liquid cargo, and so that their upper edge 14 is located at or above the liquid surface.

The units comprising said interconnected metal sheets 11,12 can be designed so as to be suspended from a frame 15 extending about every hatch. A hatch-cover 5 then is intended here to be positioned over the unit on or at the frame 15 and to close the hold 2–4.

According to a preferred embodiment of the invention, every unit is rigidly connected to or placed on one side of a hatch-cover 5–10, and the sheets 11,12 preferably are welded on to project perpendicularly from one side of the hatch-cover. This embodiment is shown especially in FIGS. 3,4 and 5. A hatch-cover 5–10 with sheets 11,12 on one side 16 preferably has a smooth opposed side 17.

According to a further embodiment, the hatch-cover 5–10 in this latter case is turnable. This implies the great advantage that the holds of the ship can be fully loaded with general cargo or bulk cargo by turning the hatch-covers so that the sheets 11,12 are on the upward facing side of the hatch-covers 5–10, but at the loading of liquid cargo the hatch-covers 5–10 can be turned so that the sheets 11,12 are on the downward facing side of the hatch-covers 11,12.

In FIG. 1 the covers 5,6 of the left-hand hold 2 are turned in the firstmentioned position, and the covers 7–10 of the remaining holds 3,4 are turned in the last-mentioned position.

Figure 3:
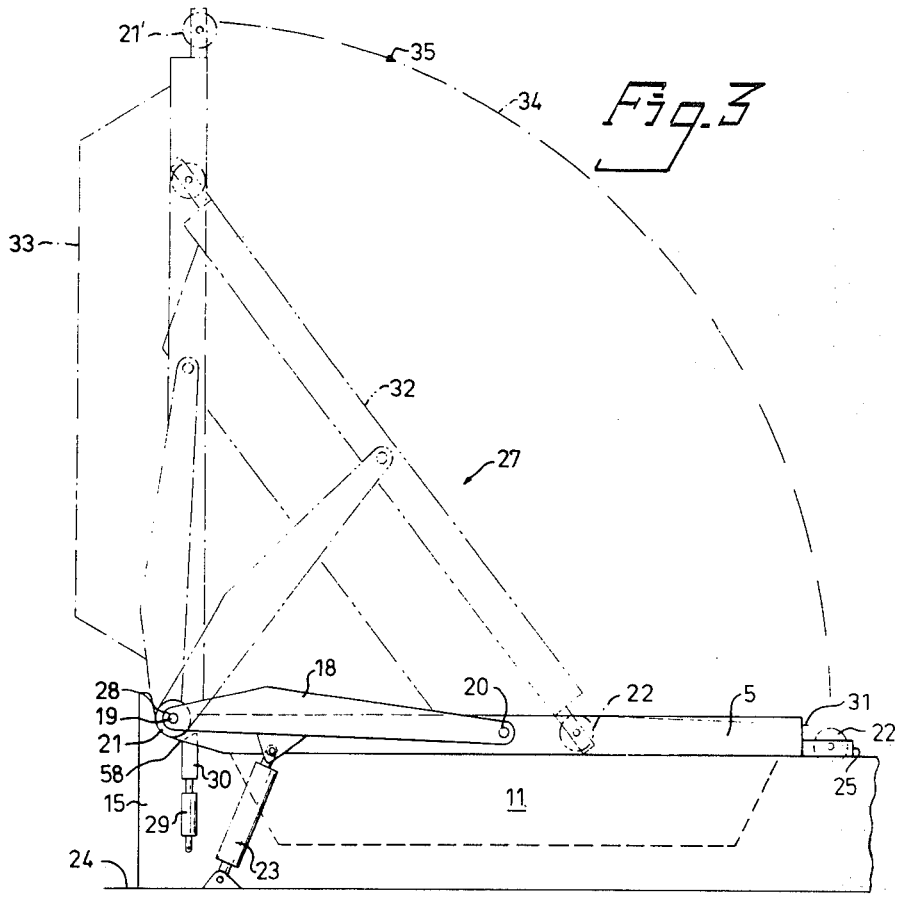
FIG. 3 shows an arrangement according to the invention with a lifting and turning device in different positions.

In FIG. 3 the numeral 27 generally designates a device for lifting and turning the hatch-covers 5–10 according to the invention.

FIG. 3 shows only one hatch-cover 5 in a view in parallel with the fore-and-aft line. The turning device comprises two arm pairs 18, which extend one on each side of the hatch-cover and are hingedly connected at one end 19 to the hull and at the other end by a joint 20 are hingedly connected to a hatch-cover 5.

The hatch-cover is provided at each of its four corners with wheels 21,22, which are mounted on projecting arms 25. The wheels may be replaced by fixed shafts. The wheels 21,22 run in grooves in the frame 15. Each arm 18 is operated by a hydraulic cylinder 23 disposed between the arm 18 and the hull 24.

When the hatch-cover 5 closes the entire hatch or a portion thereof, the axles of the two wheels 21 located at the turning center of the arms, viz. the first pair of wheels, substantially coincide with the turning axle 28 of the arms 18. Beneath each wheel of the first wheel pair 21 a wheel-locking means is located which consists of a hydraulic cylinder 29, on the piston rod of which a means 30 is located for locking and lifting the wheels 21.

The wheel-locking means also serves as a stop means to prevent the wheel 21 from moving to the right in FIG. 3. A limit member 31 is provided to limit the vertical movement of the two wheels 22, which are located farthest away from the turning center of the arms 18, viz. the second pair of wheels 22, when the hatch-cover is being turned as will be described below.

The mode of operation of the lifting and turning device is described in the following. The description proceeds from a hatch-cover 5 according to FIG. 3 in its closed position and refers to the components shown in FIG. 3. The wheel 21 at said turning center is released from the locking means 29,30 and rises, because the cylinder 23 lifts the arm 18, whereby the wheel 22 farthest away from the turning center of the arms 18 rolls in beneath the limit member 31 and thereby is prevented from being moved in the vertical direction. The cylinder 23 thereafter lifts the arm 18. The hatch-cover weight is so balanced that the portion located to the right of the joint 20 in FIG. 3 is slightly heavier than the portion located to the left, whereby the cover 5 is turned upward via the position 32 indicated by dash-dotted lines to the dash-dotted position 33 shown in FIG. 3.

The means 30 thereafter is moved by the cylinder 29 to such a position, that the wheel 22, which then is at said turning center, is prevented from being transported in the horizontal direction, whereafter the cylinder 23 moves the arms 18 downward, whereby the wheel 21' uppermost in FIG. 3 will move along substantially an arc 34 in the direction of the arrow 35 downward to a position corresponding to the position for the wheel 22 in FIG. 3. For turning back the cover 5, the arms 18 are lifted while the means 29,30 prevents the wheel at the turning center of the arms 18 to move in the horizontal direction. As in this case the cover 5 portion located to the right of the joint 20 has a lighter weight than the cover portion located to the left, the cover is lifted to the dash-dotted position 33. Thereafter the means 30 is moved down by the cylinder 29, so that the wheel located at said turning point runs down along a downward inclined plane 58 while simultaneously the arms 18 are lowered. The cover, thus, is lowered via the position 32 back to starting position.

It is, of course, possible by small alterations to turn the cover 5 every time in the same direction. In this case the cover among other things must be balanced to equilibrium at the joint 20 between the arms 18 and the cover 5. When the cover is difficult to balance, the cover movement also may be controlled by coupling a control wire or the like thereto for assisting the movement of the cover to a locked position. The turning of the cover 5 about its joint 20 on the arm 18 can be effected, instead of by the means 31,22,29,30,21, by a hydraulic cylinder or a corresponding device acting between the arm 18 and the cover 5.

Figure 4:
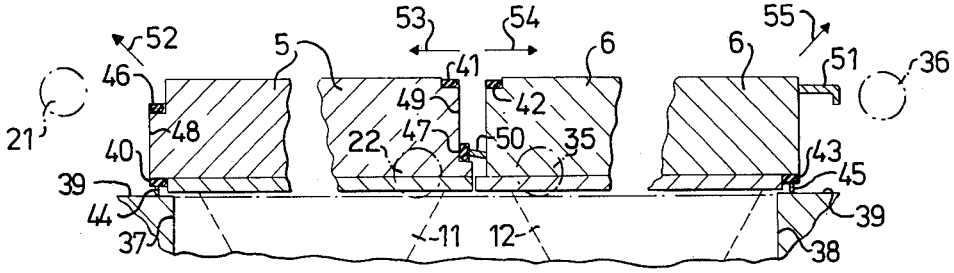
FIG. 4 is a section along the line 4—4 in FIG. 2.
Figure 5:
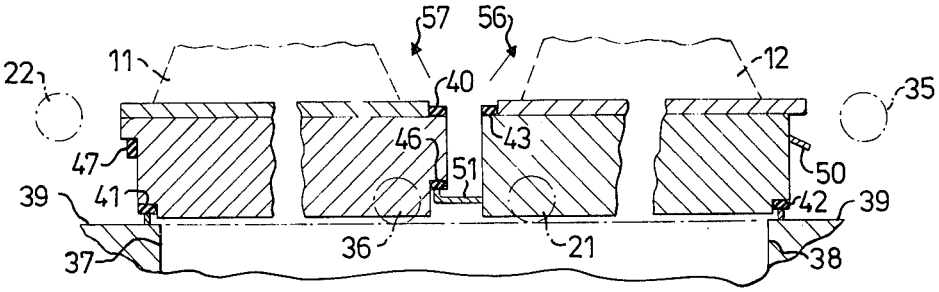
FIG. 5 is a section along the line 5—5 in FIG. 2.

In FIG. 4 two hatch-covers like the covers 5,6 in FIG. 1 are shown with their sheets 11,12 facing or directed downward. Wheels corresponding to those shown in FIG. 3 are designated by the same numerals as in FIG. 3 with respect to the left-hand cover 5, while the wheels of the right-hand cover are designated by 35,36. For reason of better clarity, the wheels in FIGS. 4 and 5 are shown with a larger diameter. In FIG. 5 the covers 5,6 are shown according to FIG. 4, but with upward facing or directed sheets 11,12. The turning of the covers 5,6 is carried out as described above. In FIGS. 1,4,5 the numerals 37,38 designate the walls of the frame 15, and 39 designates the upper edge thereof. Each cover, as shown in FIGS. 4 and 5, is provided with seals 40,41,42,43 in two diagonally located corners, and each seal is intended to seal against a metal strip 44,45 on the frame 39. One of the covers 5 further is provided with a seal 46,47 at each of its two vertical long sides 48,49, of which seals one is intended to abut one of two flanges 50,51 projecting from the other one 6 of the covers. Hereby a sealed joint is formed between the covers by one of said seals 47 and 46, respectively, and one of said projecting flanges 50 and 51, respectively, both when the sheets 11,12 of the covers 5,6 face or are directed downward and when they face upward.

Seals along the sides of the covers 5,6 in parallel with the fore-and-aft line are designed in the same way as the seals 40,43,44,45 between the covers and the deck 39.

The seals 40,41,42,43,44,46,47 preferably are made of rubber or another elastic material.

The arrows 52–57 in FIGS. 4 and 5 indicated the initial direction of movement of the covers 5,6 when they are to be turned as described above.

When the covers 5,6 are located so that the initial direction of movement of their ends adjacent each other is horizontal when the covers are to be turned, the projecting flange 50 on the one cover 6 abuts in a horizontal direction the corresponding seal 47 on the other cover 5. When the covers 5,6 are located so that the initial direction of movement of their ends adjacent each other is vertical, the projecting flange 51 on one cover 6 abuts in a vertical direction the corresponding seal 46 on the other cover 5. The seals described bring about a simple and efficient seal between the hold and the free atmosphere.

The arrangement described apparently implies very great advantages, because ships intended to carry general cargo can be converted in an extremely simple manner so as to be capable to carry liquid products.

When the cargo, for example, is oil, the stability moment of a ship, on which the present invention is utilized, is reduced only marginally compared with when the cargo is of general nature. Existing general cargo or bulk cargo ships, thus, can be equipped for carrying both liquid products and general or bulk cargo only by being provided with arrangements according to the invention.

It is, of course, possible to vary the invention without exceeding the scope of its idea. The aforesaid units, for example, can be adapted to be supported in the frame 15 as mentioned and be completely separated from the covers instead of being rigidly connected thereto.

The configuration formed of metal sheets 11,12 also can be varied substantially. The turning of covers with associated units of sheets and, respectively, the turning of covers without units of sheets can be carried out by turning devices other than according to the preferred embodiment described above.

The seals can be designed in a way different from that shown at the above embodiment.

The invention, thus, must not be regarded restricted to the embodiments described above, but can be varied within the scope of the attached claims.

I claim:

1. An arrangement for dividing the top free liquid surface of a liquid cargo shipped in general cargo and bulk cargo ships, such ships having a hull with a horizontal hatch above the free surface of the liquid cargo, the arrangement comprising:

a cover having two sides and adapted to be arranged above the hatch, a unit including a plurality of sheets on one side of the cover and projecting therefrom, said sheets having opposed upper and lower edges, the sheets forming a plurality of shieldings and a plurality of compartments located side by side, the unit being dimensioned to fit into at least a portion of the hatch, the cover being adapted to be positioned over the hatch with the sheets vertically in the hatch, the lower edges of the sheets being located below the free liquid surface of the liquid cargo and the upper edges of the sheets being located at or above the free liquid surface of the liquid cargo, the cover being turnable between a close position in which the one side is adjacent the hatch with the sheets vertically in the hatch and an open position in which the other side of the cover is adjacent the hatch, and turning means for turning the unit between the close and open positions, the turning means including arm means, the arm means having opposed ends respectively pivotally connected to the cover and the hull, the arm means being able to both lift the cover from the hatch and lower the cover onto the hatch, and means for moving the cover through a substantially vertical position to a horizontal position turned through 180 degrees relative to the starting position of the cover during the lifting of the cover from the hatch and the subsequent lowering of the cover onto the hatch.

2. The arrangement as claimed in claim 1 wherein the sheets are metal and welded on the one side of the cover.

3. The arrangement as claimed in claim 2 in which the compartments are rectangular.

4. The arrangement as claimed in claim 3 in which the rectangular compartments have dimensions corresponding to the dimensions of containers constructed according to international standards.

5. The arrangement as claimed in claim 3 in which the arm means comprises a pair of arms arranged on opposite sides of the cover.

* * * * *